US007546804B1

(12) United States Patent
Tartarilla, III et al.

(10) Patent No.: US 7,546,804 B1
(45) Date of Patent: Jun. 16, 2009

(54) ARTILLERY CHARGE WITH LASER IGNITION

(75) Inventors: Anthony E. Tartarilla, III, Rockaway, NJ (US); Henry Kerwien, Augusta, NJ (US); Thomas DeVoe, Oak Ridge, NJ (US); Joseph Leone, Oak Ridge, NJ (US); Luke Helsel, Rockaway, NJ (US); Nicholas Turner, Odenton, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 195 days.

(21) Appl. No.: 11/548,103

(22) Filed: Oct. 10, 2006

(51) Int. Cl.
*F42C 19/00* (2006.01)
*C06C 7/00* (2006.01)
*F42B 5/26* (2006.01)

(52) U.S. Cl. ..... 102/201; 102/202; 102/275.11; 102/470; 102/471

(58) Field of Classification Search ..... 102/201, 102/202, 275.11, 470, 471
See application file for complete search history.

(56) References Cited

U.S. PATENT DOCUMENTS 3,611,939 A * 10/1971 Stadler et al. ..... 102/204
3,760,729 A * 9/1973 Freeman ..... 102/346
4,782,758 A * 11/1988 Washburn ..... 102/434
4,922,823 A * 5/1990 Rahnenfuhrer et al. ..... 102/288
5,063,848 A * 11/1991 Tucker et al. ..... 102/282
5,081,930 A * 1/1992 Williams ..... 102/292
5,155,293 A * 10/1992 Barton ..... 102/312
5,179,246 A * 1/1993 Betts et al. ..... 102/201
5,282,423 A * 2/1994 Sikorski et al. ..... 102/431
5,323,707 A * 6/1994 Norton et al. ..... 102/431
5,421,264 A * 6/1995 Petrick ..... 102/443
5,454,323 A * 10/1995 Conil ..... 102/282
5,578,787 A * 11/1996 Kobari et al. ..... 102/288
5,672,842 A * 9/1997 Brion et al. ..... 102/282
5,747,723 A * 5/1998 Buckalew et al. ..... 102/282
5,914,458 A * 6/1999 Folsom et al. ..... 102/201
6,047,643 A * 4/2000 Benner et al. ..... 102/201
6,212,989 B1 * 4/2001 Beyer et al. ..... 89/17
6,227,116 B1 * 5/2001 Dumenko ..... 102/275.3
6,343,552 B1 * 2/2002 Harris ..... 102/282
6,360,666 B1 * 3/2002 Harris ..... 102/430
6,415,715 B1 * 7/2002 Nilsson et al. ..... 102/288
6,460,459 B1 * 10/2002 Mc Cahon et al. ..... 102/201
6,539,869 B2 * 4/2003 Knowlton et al. ..... 102/275.3
7,201,103 B1 * 4/2007 Englund ..... 102/201
7,204,190 B2 * 4/2007 Englund ..... 102/201
2002/0035945 A1 * 3/2002 Knowlton et al. ..... 102/275.3
2008/0134921 A1 * 6/2008 Nance ..... 102/202.5

* cited by examiner

*Primary Examiner*—James S Bergin
*Assistant Examiner*—Michael D David
(74) *Attorney, Agent, or Firm*—Michael C. Sachs

(57) ABSTRACT

An artillery charge includes a generally cylindrical body with a hollow core; propellant disposed in the body and first energetic material disposed in the hollow core; and a seal disposed over one end of the hollow core, the seal including second energetic material disposed therein. A laser igniter ignites the second energetic material in the seal, thereby providing more reliable ignition of the first energetic material and the propellant. The artillery charge reliably ignites using a lower powered laser than known charges.

11 Claims, 2 Drawing Sheets

ARTILLERY CHARGE WITH LASER IGNITION

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to artillery charges that are ignited with a laser.

Modular artillery charges are known, for example, from U.S. Pat. No. 5,747,723 issued on May 5, 1998, which is hereby incorporated by reference. FIG. 1 is a schematic sectional view of a modular artillery charge 10. Charge 10 comprises a generally cylindrical body 12 with a hollow core 14. Propellant 18 is disposed in body 12. A core igniter bag 16 filled with energetic material is disposed in the hollow core 14. The ends 24 of the hollow core 14 are typically enlarged in a conical shape. The enlarged ends 24 hold end igniter bags 20 that are filled with energetic material. The enlarged ends 24 are sealed from the environment by a pair of seals 22. Each seal 22 is usually a piece of thin, transparent, waterproof material, such as Mylar. The seal 22 is attached to the end of body 12 using, for example, an adhesive 26.

The charge 10 is loaded in a gun and ignited by a laser. Because the ends 24 of charge 10 are identical, either end may be used for ignition. The laser beam passes through the seal 22 and ignites the energetic material in end igniter bag 20. The energetic material in end igniter bag 20 then ignites core igniter bag 16, which ignites the propellant 18. However, the ignition process is not without problems. FIG. 2 is an enlarged schematic side view of one end of the charge 10. End igniter bag 20 includes stitches 28. If the stitches 28 of the end igniter bag 20 are misaligned they become drawn too far into the centerline of charge 10. The laser 30 then impinges on the stitches 28 of the end igniter bag 20, resulting in delayed or no ignition of the energetic material in igniter bag 20.

FIG. 3 is an enlarged schematic view of one end of charge 10. In FIG. 3, the offset distance 0 between the seal 22 and the igniter bag 20 is large. The seal 22 and adhesive 26 act as a diffuser for the laser 30 and force the coherent beam to scatter over a very short distance. The diffusion is exacerbated by the red dye that is applied to the exterior of seal 22. If the separation between the seal 22 and the bag 20 is excessive, as in FIG. 3, the laser energy incident on the bag 20 falls below the required threshold and results in cannon misfire. Thus, there is a need for an artillery charge that can be reliably ignited by a laser. It is also desirable to utilize a lower powered laser to ignite the artillery charge.

SUMMARY OF THE INVENTION

It is an object of the invention to provide a laser ignited artillery charge that has greater firing reliability.

It is another object of the invention to provide a laser ignited artillery charge that is reliably ignited with less laser power than known charges.

One aspect of the invention is an artillery charge comprising a generally cylindrical body with a hollow core; propellant disposed in the body and first energetic material disposed in the hollow core; and a seal disposed over one end of the hollow core, the seal including second energetic material disposed therein. The first energetic material may be disposed in bags, the bags including a core igniter bag disposed in the hollow core and an end igniter bag disposed in the one end of the hollow core.

In one embodiment, the second energetic material comprises one or more of black powder, MIC and MIC-10. Preferably, the seal comprises a thin, transparent, waterproof material.

Another aspect of the invention is a method comprising providing an artillery charge comprising a generally cylindrical body with a hollow core; propellant disposed in the body and first energetic material disposed in the hollow core; placing a seal over one end of the hollow core, the seal including second energetic material disposed therein; and initiating the second energetic material in the seal with a laser. The first energetic material may be disposed in bags, the bags including a core igniter bag disposed in the hollow core and an end igniter bag disposed in the one end of the hollow core.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
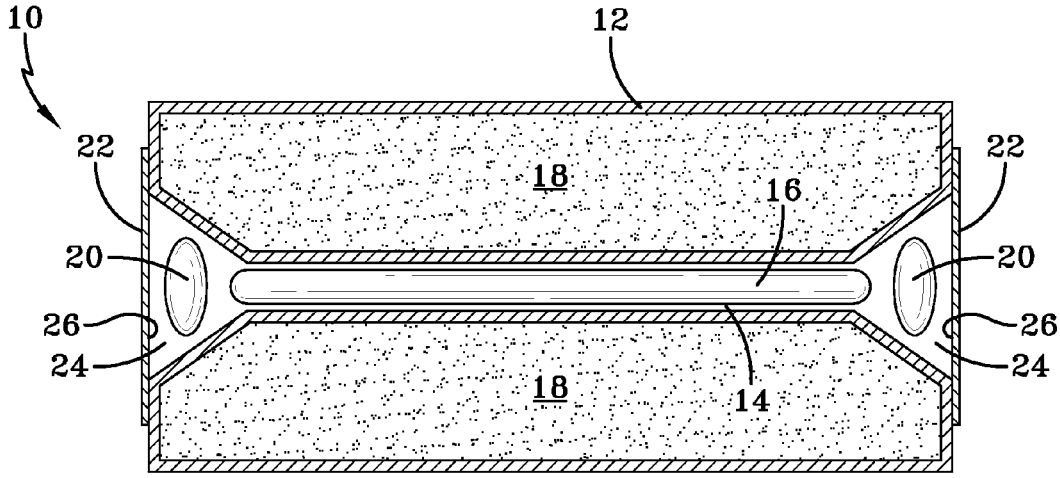
FIG-1 PRIOR ART
FIG. 1 is a schematic sectional view of a known modular artillery charge.
Figure 2:
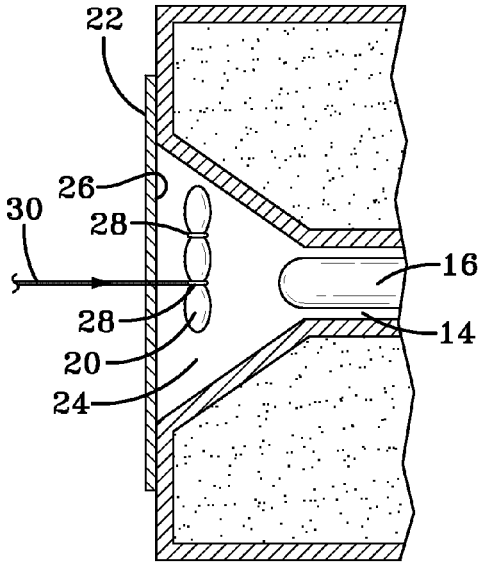
FIG-2 PRIOR ART
FIG. 2 is an enlarged view of one end of FIG. 1.
Figure 3:
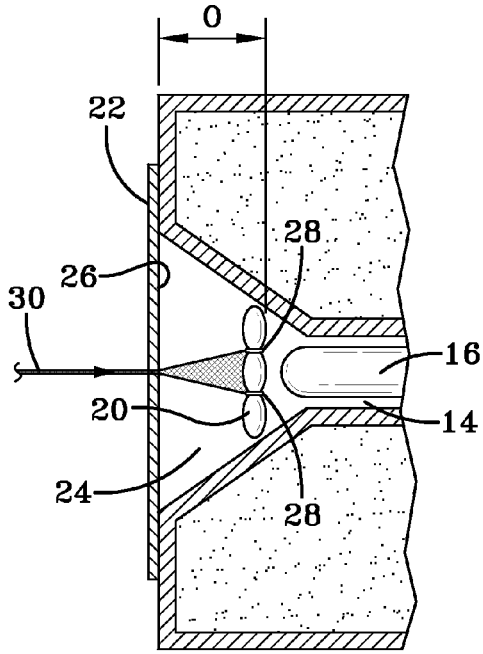
FIG-3 PRIOR ART
FIG. 3 is an enlarged view of one end of FIG. 1.

The invention relates to the interface between the laser igniter and the propelling charge in an artillery weapon, for example, a 155 mm howitzer. The invention is a new configuration for a propelling charge that makes the propelling charge more reactive to laser energy. The invention enhances the optical coupling between the laser igniter and the propelling charge. In one embodiment, the invention uses the basic configuration of a modular artillery charge 10 shown in FIGS. 1-3.

Figure 4:
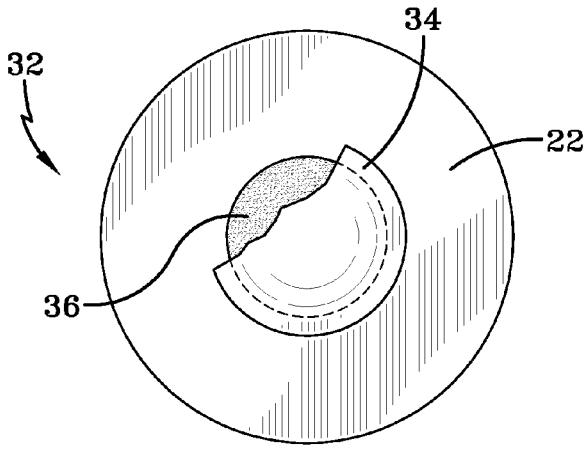
FIG. 4 is a schematic top view of one embodiment of the invention.

FIG. 4 is a schematic top view of one embodiment of an apparatus 32 according to the invention. The apparatus 32 is an improved end seal for the ends 24 (FIGS. 1-3) of the hollow core 14. Apparatus 32 includes a conventional seal 22 and a small amount of energetic material 36 disposed on an interior of the seal 22. By way of example only, the amount of energetic material 36 may be about 0.025 milliliters. The energetic material 36 is disposed on the seal 22 such that when the seal 22 is applied to the charge 10, the energetic material 36 is at the centerline of the charge 10, i.e., directly in the path of the laser igniter.

The energetic material 36 may be secured to seal 22 by a variety of means. For example, a second seal or cover 34 may be applied to the inside of seal 22 over the energetic material 36 to form a pocket. The cover 34 is made of a thin, transparent material, such as Mylar. The energetic material 36 may comprise one or more of, for example, black powder, metastable intermolecular composite (MIC) or MIC-10.

Figure 5A:
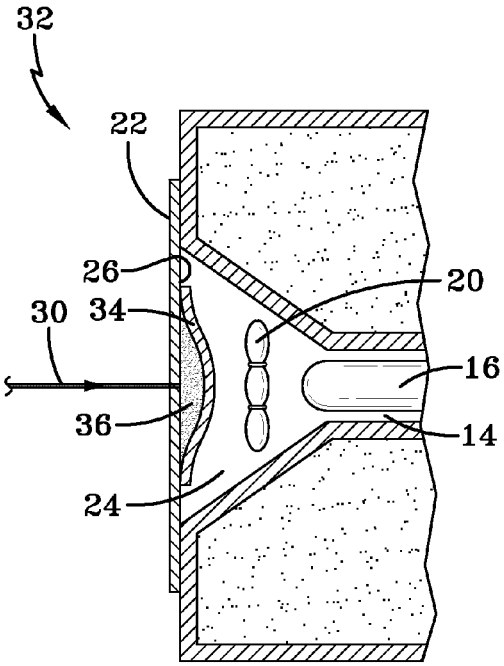
FIGS. 5A and 5B are schematic side views of one embodiment of the invention.
Figure 5B:
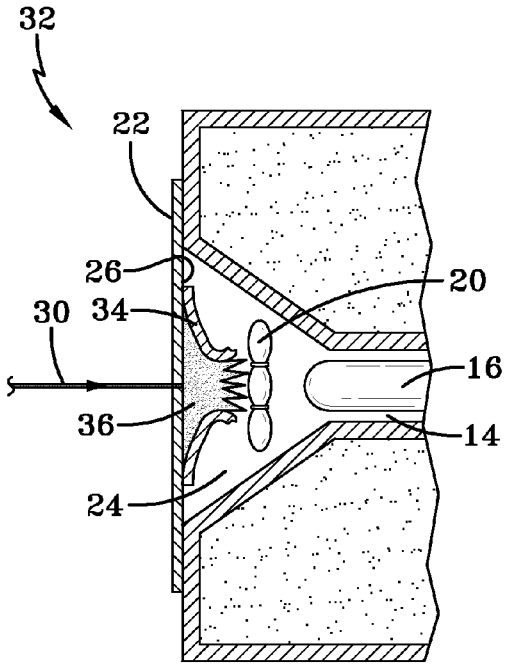

FIGS. 5A and 5B are schematic side views of the apparatus 32 shown in FIG. 4. Apparatus 32 is applied to the end 24 of the hollow core, over end igniter bag 20. FIG. 5A shows the laser 30 incident upon the energetic material 36 in seal 32. In FIG. 5B, the laser 30 has caused the energetic material 36 to ignite. The energetic material 36 will then ignite the igniter bag 20. Neither of the conditions shown in FIGS. 2 and 3 will prevent the ignition of igniter bag 20. Thus, the apparatus 32 provides a more reliable laser ignition of the charge 10. Because only one end of a charge 10 is used for ignition, the apparatus 32 may be applied to only one end of the charge. However, to avoid having to reload an improperly loaded charge, both ends of the charge may include the apparatus 32.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An artillery charge that is ignited by a laser beam, comprising:

a generally cylindrical body having a hollow core that is axially disposed within the body, along a path of the laser beam;

wherein the hollow core includes a first end and a second end;

a propellant disposed in the body, around the hollow core;

a core igniter bag containing a core energetic material, wherein the core igniter bag is axially disposed relative to the body, inside the hollow core;

a first end igniter bag that is generally co-axially disposed relative to the core igniter bag, inside the first end of the hollow core;

wherein the first end igniter bag contains a first energetic material;

a first seal disposed over the first end of the hollow core;

the first seal having an internal surface;

wherein the internal surface of the first seal forms a first pocket that is generally co-axially disposed relative to the first end igniter bag, at a distance from the first end igniter bag, inside the first end of the hollow core;

a second energetic material disposed against the internal surface of the first seal, within the first pocket of the first seal;

wherein the loser beam ignites the second energetic material for reducing the scattering of the laser beam;

wherein the ignited second energetic material, in turn, ignites the first energetic material inside the first end igniter bag;

wherein the ignited first energetic material, in turn, ignites the core energetic material inside the core igniter bag; and wherein the ignited core energetic material, in turn, ignites the propellant.

2. The artillery charge of claim 1, wherein the second energetic material comprises one or more of black powder, metastable intermolecular composite, MIC, and metastable intermolecular composite-10, MIC-10.

3. The artillery charge of claim 1, wherein the first end of the hollow core is enlarged for housing the first end igniter bag and the first pocket.

4. The artillery charge of claim 1, wherein the first seal comprises a thin, transparent, waterproof material.

5. The artillery charge of claim 4, wherein the first seal comprises Mylar.

6. The artillery charge of claim 1, wherein the amount of the second energetic material is approximately 0.025 milliliters.

7. The artillery charge of claim 1, wherein the first pocket is formed by a cover that is secured to the internal surface of the first seal.

8. The artillery charge of claim 1, further including a second end igniter bag that is generally co-axially disposed relative to the core igniter bag, inside the second end of the hollow core.

9. The artillery charge of claim 8, wherein the second end igniter bag contains an energetic material.

10. The artillery charge of claim 9, wherein the energetic material contained in the second end igniter bag includes the first energetic material.

11. The artillery charge of claim 10, further including:

a second seal disposed over the second end of the hollow core, wherein the second seal has an internal surface;

wherein the internal surface of the second seal forms a second pocket that is generally co-axially disposed relative to the second end igniter bag, at a distance from the first igniter bag, inside the second end of the hollow core; and wherein the second pocket contains another energetic material the includes the second energetic material, and is disposed against the internal surface of the second seal, within the second pocket of the second seal.

* * * * *